US005303967A

United States Patent [19]

Dubow

[11] Patent Number: 5,303,967

[45] Date of Patent: Apr. 19, 1994

[54] GOLF BALL RETRIEVING DEVICE

[76] Inventor: Irvine L. Dubow, 5901 Almaden Dr., Naples, Fla. 33999

[21] Appl. No.: 20,348

[22] Filed: Feb. 22, 1993

[51] Int. Cl.[5] ..... A63B 47/02

[52] U.S. Cl. ..... 294/19.2; 56/400.18

[58] Field of Search ..... 294/19.1, 19.2, 24, 294/50, 50.5, 51, 55, 55.5, 66.1, 99.1, 100; 56/400.11, 400.18–400.2, 328.1, 332; 273/32 B, 32 F, 162 B, 162 E, 162 F

[56] References Cited

U.S. PATENT DOCUMENTS

| | | | |
|---|---|---|---|
| 531,449 | 12/1894 | Smith | 294/50.5 |
| 2,083,786 | 6/1937 | Jerner et al. | 56/400.18 |
| 2,904,951 | 9/1959 | Glover | 56/400.18 |
| 3,258,903 | 7/1966 | Rienacker et al. | 56/400.18 |
| 3,318,628 | 5/1967 | White | 294/19.2 |
| 3,374,025 | 3/1968 | Mantelet | 294/100 X |
| 4,236,742 | 12/1980 | Florence | 294/19.2 X |
| 4,466,650 | 8/1984 | Roedel | 294/19.2 |
| 4,974,894 | 12/1990 | Dubow | 294/19.2 |

*Primary Examiner*—Johnny D. Cherry
*Attorney, Agent, or Firm*—Leo Gregory

[57] ABSTRACT

A golf ball retrieving device to withdraw a golf ball from a water hole providing an extensible reach and an expandable cage to receive a golf ball for recovery by the operator, the cage having inwardly angled end forming pockets to receive and securely hold a ball and having a self holding member for operating the expansion and retraction of the cage.

1 Claim, 2 Drawing Sheets

GOLF BALL RETRIEVING DEVICE

BACKGROUND OF THE INVENTION

1. Field of Invention

This invention relates to an extensible handled tool for the convenient recovery of a golf ball from a water hazard on a golf course.

2. Description of the Previous Art

Known in the prior art are various handled devices for the retrieval of a golf ball from a water hazard on a golf course.

The inventor hereof has a prior issued U.S. Pat. No. 4,974,994 over which the present structure herein represents some significant changes.

Indicative of the other prior art is U.S. Pat. No. 3,318,628 which discloses a small collapsible cage which can be withdrawn into its handle and which is inserted into a golf hole to withdraw the ball.

In U.S. Pat. No. 4,466,650, there is disclosed a handle having a mounting at its other end to position a tee member into the ground.

In U.S. Pat. No. 4,254,981, there is disclosed a ball retriever which consists of a plurality of uniform tines which may be variably spread apart and which have elongated curved ends to rake a ball out of a water hazard.

It is desirable to have an extensible tool to readily retrieve a golf ball from a water hazard and which will securely hold one or more balls thus retrieved.

SUMMARY OF THE INVENTION

It is an object of this invention to provide a cage-like device which enables the operator to readily retrieve a golf ball from some distance out into a water hazard on a golf course.

It is a further object herein to provide a device which securely entraps a ball once it is picked up with said device.

More particularly, it is an object of this invention to provide a device for the retrieval of a golf ball from a water hazard, the device having an expandable open sided cage and an extensible or telescopic handle, the cage comprising a plurality of prongs having inwardly angled ends with the prongs forming more than one pocket within a chamber therein and which securely entraps one or two retrieved balls until their removal by the operator.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
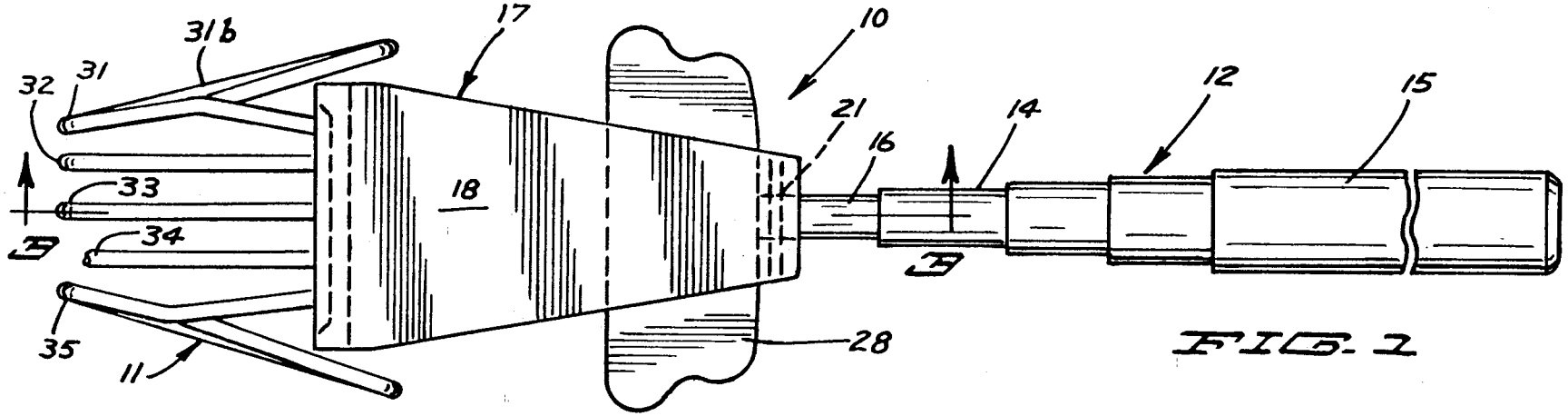
FIG. 1 is a top plan view with a portion broken away.

The invention herein is of a device intended to be used to recover golf balls from water holes or water hazards on a golf course. The device is indicated generally by the reference numeral 10.

Referring to FIG. 1, said device 10 consists of a cage or cage-like member 11 mounted, as will be described, at one end of an extensible or telescopic handle 12 which may be extended as required such as up to a length of twenty or twenty-five feet.

The handle is of a conventional tubular structure such as formed of an aluminum or other suitable lightweight metal extensible tubes and requires no description as to makeup or function. However, at the hand holding end of said handle, there is mounted a hand grip 15 formed of a suitable plastic or rubber material much like the hand grip on the handlebars of a bicycle.

At the forward end of said handle, there is a terminal segment 16 and with preceding like segment portions such as 14 is fully drawn into the handle 12 in a retracted position.

Attached to said segment 16 is an elongated frame-like housing or casing 17 which is substantially a tapered rectangle in form having spaced upper and lower walls 18 and 19 which taper in the direction of said handle and are joined at their front and rear ends by a front wall 22 and a rear wall 20, the rear wall having an aperture 21 therein into which the adjacent end **16*b* of said segment 16 is disposed and suitably secured as by a pin 16*c*. Said end wall 20 will have a sufficient thickness to secure said segment 16**.

The forward or front end wall 22 of said housing is seen to be substantially wider than said rear wall 20 and is apertured in a horizontal line thereacross by holes or passages **22*a*** of which those at each side of the center one are angled outwardly in a diverging fan-like arrangement as shown.

Disposed within said housing 17 for longitudinal sliding movement therein is a hand manipulated operating block 28 substantially rectangular in plan extending outwardly at each side of said housing with a slightly wider front end portion **28*a* than a rear end portion 28*b*. Indentations or finger grips 28*e*** are formed at each side thereof for easy hand manipulation or hand movement of said block.

Formed into the forward upper surface portion of said block are a number of diverging fan-like grooves **28*c* with each terminating at its inner end in a vertical bore 28*d***. In the present embodiment, for purpose of example, five grooves are shown.

Mounted onto or secured to said block 28 is an open ended cage-like ball retrieving member 11. Said member 11 comprises a number of transversely disposed radially diverging prongs 31–35 as here shown. Said prongs have spacing therebetween less than that of the diameter of a golf ball. The inner end portions of said prongs as at **33*d* are bent at right angles whereby the straight rearward portions of said prongs as at 33*c* are seated within said grooves 28*c* and their right angled inner end portions as at 33*d* are disposed into corresponding ones of said vertical bores 28*d*** as indicated.

Now with particular reference to said operating block, the movement of the operator's hand will move it forwardly or rearwardly as may be desired with finger engagement upon the finger grip indentations **28*e***.

Figure 2:
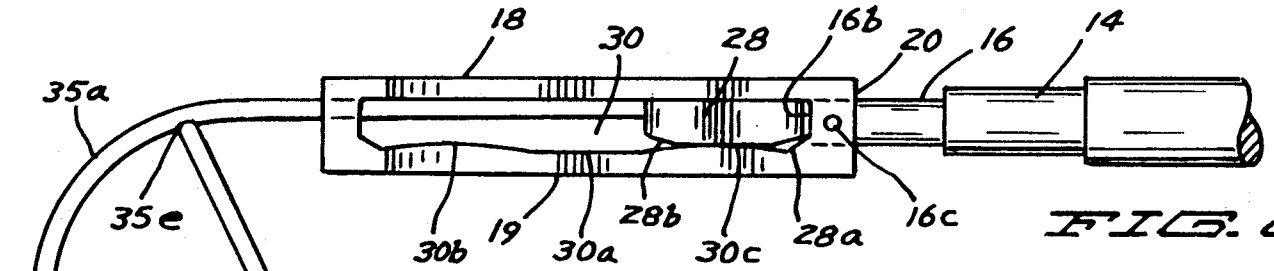
FIG. 2 is a view similar to that of FIG. 1 in side elevation.
Figure 3:
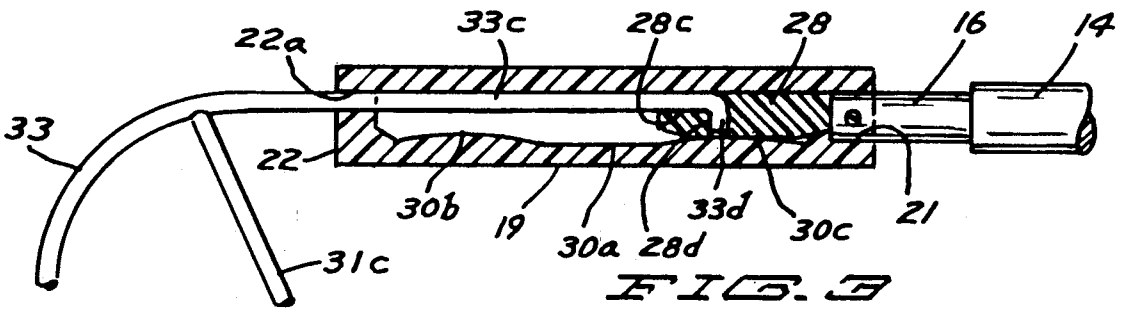
FIG. 3 is a broken view in vertical section taken on line 3—3 of FIG. 1 as indicated.

Between said upper and lower walls 18 and 19 is an open sided slot 30 through which said operating block extends outwardly of said housing. Said housing will be of such a length and said operating block therein also of such a length as to retract and withdraw said prongs for convenient carrying as indicated in FIGS. 1 and 2.

It is important for said block to slide easily within said slot 30 and yet have sufficient frictional engagement to adequately hold said prongs in extended or retracted position.

To provide for the good holding engagement desired and for the purpose of illustrating one desirable embodiment, the thickness of said block is indicated as being 9 mm. The height of said slot is indicated as being 9½ mm at its maximum height as indicated at 30*a* and from said central maximum height portion of said slot, the bottom wall is sloped upwardly arcuately to have a maximum height of 8 mm as at 30*b* and 30*c*.

To ease the passage of said block within said slot, the end corners at 28*b* and 28*g* are cut away to leave a sloping end edge on the order of 15° for easy sliding movement of said block through the 8 mm heights of said slot. Thus, at either end of said slot 30, said operating block is frictionally held by the area of reduced height in said slot.

Now with particular reference to said prongs, said prongs are in non-uniform groups. The outward pair of said prongs, namely prongs 31 and 35, have a greater downward or lengthwise projection than the others as shown in FIG. 2 and each prong describes an intermediate curvature as indicated and represented at 35*a* and then flattens out into a straight segment as at 35*b* and is then angled upwardly as at 35*c* with a straight segment extending substantially to the beginning of said curvature to form a closed loop 35*d* and is there secured as by welding at 35*e*. The loops thus formed are of a size such that a golf ball will not pass through. These loops form the side walls of the cage.

The pair of prongs 32 and 34 inwardly of and respectively adjacent to said prongs 31 and 35 project downwardly somewhat less than said prongs 31 and 35 and have a substantially corresponding curvature such as at 34*a* with respect to the corresponding curved portions of the prongs 31 and 35 and have their inner ends respectively forming upwardly angled or hook portions 32*b* and 34*b*; however, their lower straight portions as at 34*c*, extend outwardly slightly more than corresponding portions of 31*b* and 35*b*.

Figure 5:
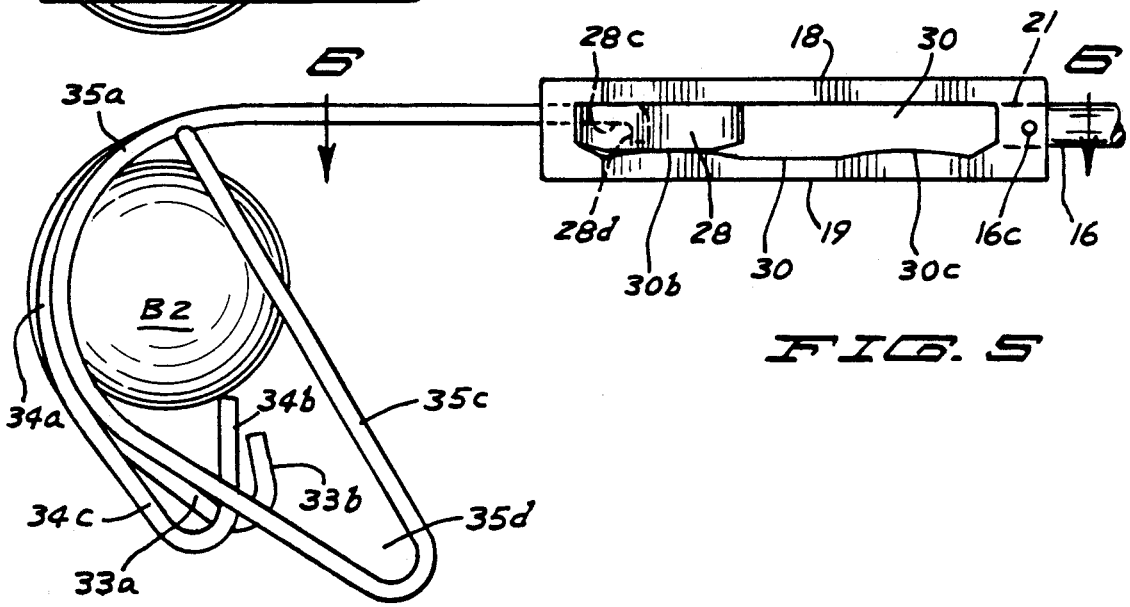
FIG. 5 is a side elevational view in operating position similar to that of FIG. 4.
Figure 6:
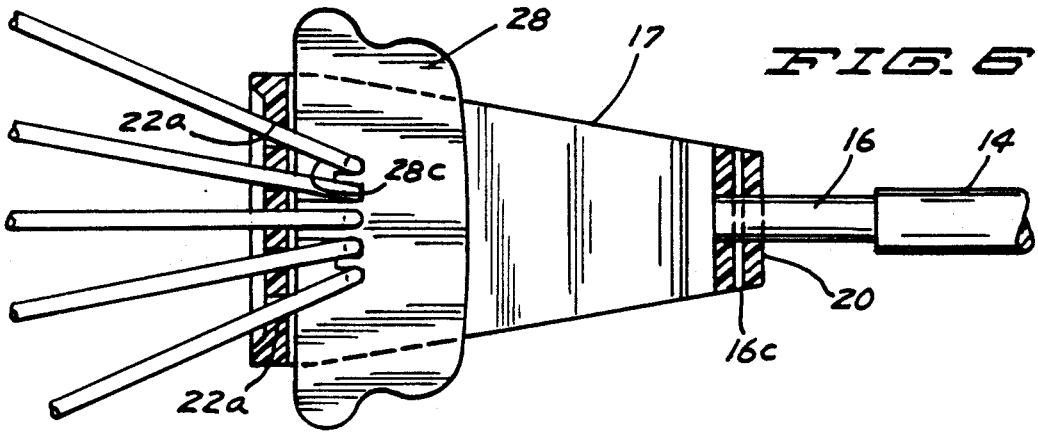
FIG. 6 is a broken view in horizontal section taken on line 6—6 of FIG. 5 as indicated.

The center prong 33 has a somewhat less curvature and has its straight portion 31*c* angled inwardly more than the corresponding portions of the prongs 32 and 34 in FIG. 5 and its inner end portion is angled upwardly at 33*b* somewhat more acutely than said ends 32*b* and 34*b*.

It has been found that for very good performance, the hook portions of the prongs 32 and 34 should be on the order of one and one quarter inches in length and angled upwardly at approximately 42° and the center prong has its angled end portion approximately one half inch in length and angled approximately 26°.

Figure 4:
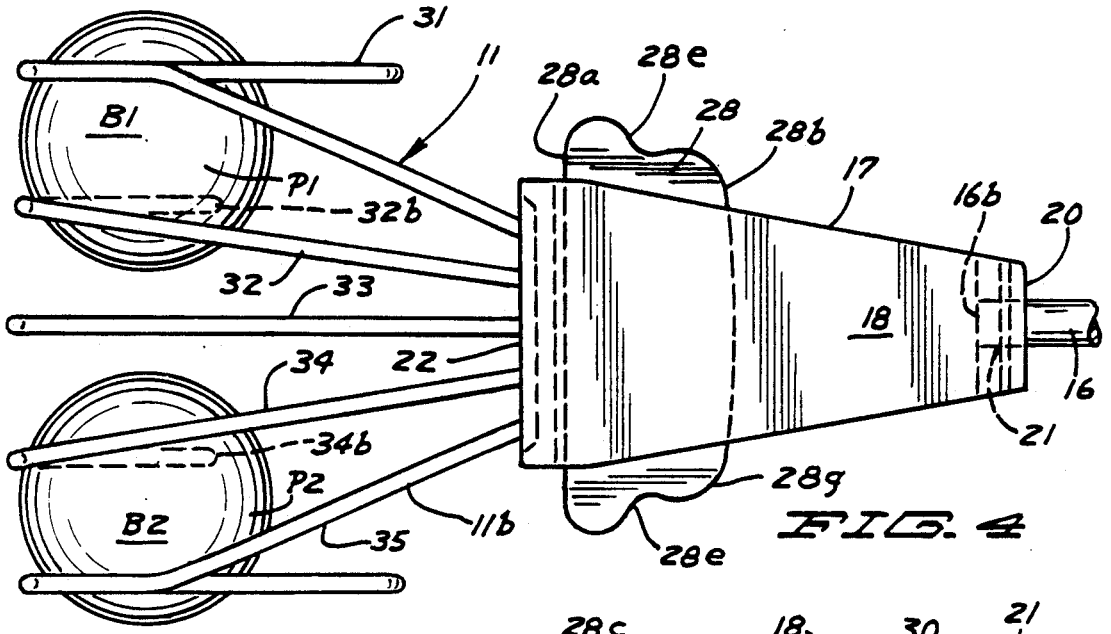
FIG. 4 is a view similar to that of FIG. 1 in top plan in expanded operating position showing a pair of golf balls entrapped therein.

Thus as described, said cage is formed to have in effect one pocket P1 formed by the prongs 31–33 and a second pocket P2 formed by the prongs 33–35. Balls such as B1 and B2, entrapped by this cage, will gravitate to and rest in one or the other of said pockets or, if so utilized, the cage will readily receive and entrap two balls, as shown in FIG. 4. The cage as thus formed may be said to have an open side 11*b* for the passage of a ball thereinto.

The hook portions of the prongs 32–34 very nicely hold a ball or balls in a trapped position. Upon retrieval, the operator merely turns the cage to have its open side face downwardly and pluck the balls out.

Next will be described the operation of the housing 17 and its internal operating block 28. As described, the cage member 11 has its respective prongs secured to said block and said prongs extend through the passages 22*a* in the front wall of said housing.

Said operating block 28 by means of the operator engaging the finger grips 28*e*, as has been indicated, is readily slidable within the slot 30. As the operating block is moved forwardly, said prongs diverge and spread out due to the divergence of the passages 22*a* and in order to readily accommodate two golf balls within said cage, the spread is on the order of four inches with the prongs at their widest point of divergence being not more than one inch apart.

For carrying or storage purposes, the operating block is moved rearwardly and the cage is contracted.

In use, the cage will be expanded and the handle extended whatever distance is required, up to its limit, to reach the ball in a water hazard. The cage will be poised just beyond the ball and lowered to be drawn over the ball. The buoyancy of the ball in the water, or in other words, the force of the water in supporting the ball is sufficient to have the ball enter said cage and the ball is immediately entrapped therein.

The operator then draws the handle and the cage unto himself to readily remove the ball by hand. The ball or balls, as the case may be, are securely held within the cage during retrieval. It is understood that the cage as here described is fully adequate to retrieve two balls either simultaneously or successively.

The retrieving device herein described has proven to be very effective and very easy to use in retrieving balls. Other devices require particular care not to lose a ball in the retrieval operation but with the device herein, once the ball is in the cage, it is securely entrapped and held.

It will of course be understood that various changes may be made in form, details, arrangement and proportions of the product without departing from the scope of the invention which, generally stated, consists in a product capable of carrying out the objects above set forth, in the parts and combination of parts disclosed and defined in the appended claims.

What is claimed is:

1. A device for retrieving a golf ball from a water hole on a golf course, comprising a handle having extensible segments, a housing carrying a ball retrieving member at one end of said handle, said member comprising a cage having an open side and consisting of a plurality of forwardly diverging prongs having inwardly angled ends, said housing having a transverse slot therein, a block member frictionally slidable in said slot extending outwardly thereof, said block member having a front end portion including diverging grooves to receive said prongs, said housing having a front end wall having diverging holes therein corresponding to said grooves, a vertical bore in each groove to receive corresponding inner angled ends of said prongs, means in said slot to hold said block member in any given position therein, said means comprises a central maximum 9½ mm. height portion of said slot and a height of 8 mm. spaced inwardly from either end of said 9½ mm. height, and said block member has a height in excess of said 8 mm. height for frictional engagement in said slot in moving therein.

* * * * *